United States Patent [19]

Laar et al.

[11] 4,182,567

[45] Jan. 8, 1980

[54] APPARATUS FOR CONTINUOUSLY PROCESSING PHOTOGRAPHIC FILMS OR THE LIKE

[75] Inventors: Erwin Laar, Taufkirchen; Karl-Heinz Wagner, Münich; Siegfried Krauss, Weilheim, all of Fed. Rep. of Germany

[73] Assignee: AGFA-Gevaert, A.G., Leverkusen, Fed. Rep. of Germany

[21] Appl. No.: 925,517

[22] Filed: Jul. 17, 1978

[30] Foreign Application Priority Data

Jul. 21, 1977 [DE] Fed. Rep. of Germany ..... 2733030

[51] Int. Cl.[2] ..... G03D 13/00

[52] U.S. Cl. ..... 354/299; 354/324; 219/328; 219/332; 219/496

[58] Field of Search ..... 354/297, 299, 324, 323; 137/563, 341; 219/287, 327, 328, 332, 496; 417/43

[56] References Cited

U.S. PATENT DOCUMENTS

| | | | |
|---|---|---|---|
| 3,781,520 | 12/1973 | Gardom | 219/496 |
| 3,851,662 | 12/1974 | Jessop | 354/324 |
| 3,873,808 | 3/1975 | Patton | 219/496 |
| 3,978,506 | 8/1976 | Geyken et al. | 354/324 |
| 4,104,668 | 8/1978 | Laar | 354/299 |

*Primary Examiner*—L. T. Hix
*Assistant Examiner*—Alan Mathews
*Attorney, Agent, or Firm*—Peter K. Kontler

[57] ABSTRACT

A continuous processor for exposed webs of photographic paper has several tanks and a system of hoses which connect the outlets in the lower portions with the inlets in the upper portions of the tanks. The liquid developer is circulated by a pump and is heated by a heater before it reaches the inlets. The pressure of liquid in the system of hoses is monitored by two pressure responsive switches which cause a control unit to arrest the motor of the pump and to deactivate the heater when the pressure drops below or rises above a range of acceptable pressures. The pressure drops in response to leakage of developer, and the pressure rises in response to clogging of a filter which is installed in the system of hoses between the heater and the inlets of the tanks.

9 Claims, 1 Drawing Figure

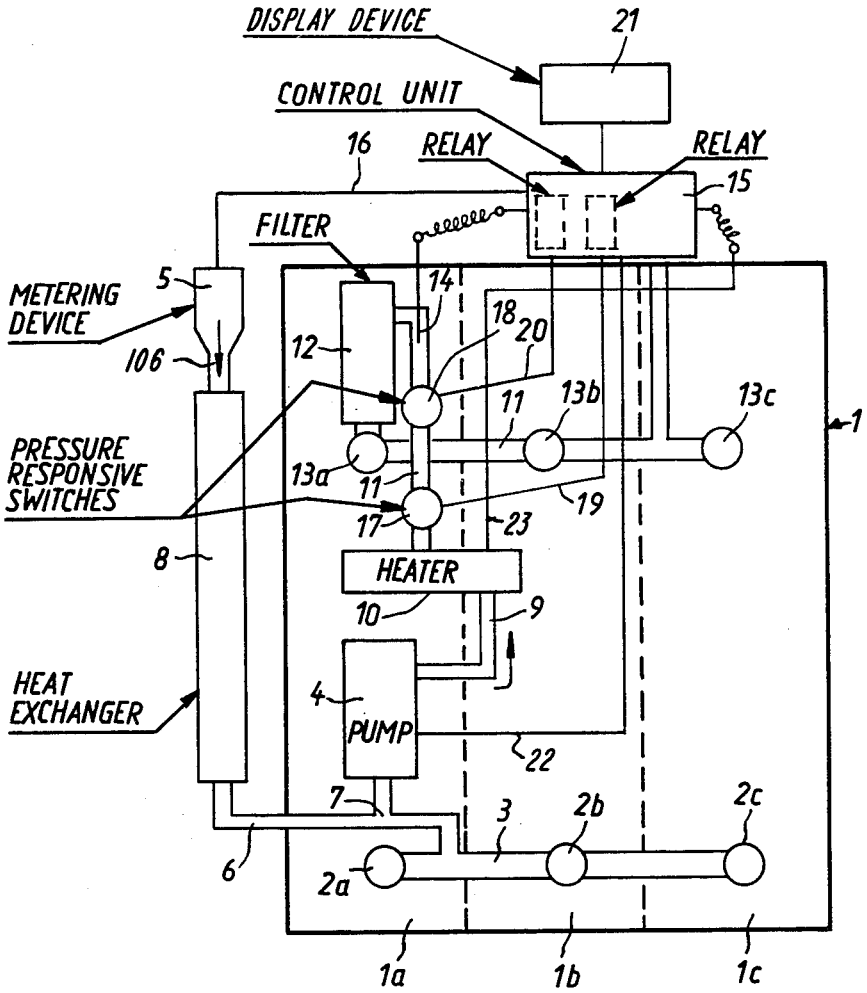
DISPLAY DEVICE
21
CONTROL UNIT
16
RELAY
RELAY
15
FILTER
METERING DEVICE
5
106
14
18
20
12
11
13b
13c
1
PRESSURE RESPONSIVE SWITCHES
13a
11
19
17
23
8
HEATER
10
9
HEAT EXCHANGER
4
PUMP
22
7
3
2b
2c
6
2a
1a
1b
1c

APPARATUS FOR CONTINUOUSLY PROCESSING PHOTOGRAPHIC FILMS OR THE LIKE

CROSS-REFERENCE TO RELATED APPLICATION

The apparatus of the present invention constitutes an improvement over and a further development of apparatus which is disclosed in the commonly owned copending application Ser. No. 783,800 filed Apr. 1, 1977 by Erwin Laar for "Continuous processor for photographic films or the like," now U.S. Pat. No. 4,108,668 granted Aug. 1, 1978.

BACKGROUND OF THE INVENTION

The present invention relates to improvements in apparatus for processing exposed photographic films or exposed webs of photographic paper, and more particularly to improvements in continuous processors for webs or strips of exposed photographic material. Still more particularly, the invention relates to improvements in processors of the type disclosed in the aforementioned copending application Ser. No. 783,800 of Erwin Laar.

The application of Laar discloses a processor wherein the material to be developed is transported through several tanks which contain supplies of a liquid processing medium and wherein the temperature of the liquid is maintained within a desired narrow range by a composite heating device. The liquid is withdrawn from the lower portions and is returned to the upper portions of the tanks by flowing through a pump, thereupon through the heating device and finally through a filter. The apparatus of Laar is designed to insure that the temperature of the liquid which reenters the tanks is always maintained within an extremely narrow optimum range. As a rule, the conduits through which the liquid flows from the outlets to the inlets of the respective tanks are flexible hoses which are secured to the nipples of the inlets and outlets of the respective tanks by suitable clamps or the like. It can happen, from time to time, that a hose becomes detached from the respective nipple or nipples, and/or that a hose develops a leak. If the hose or hoses are disconnected or permit liquid to escape for another reason, the pump is likely to be damaged or destroyed if its motor continues to run while the intake of the pump does not receive any or receives negligible quantities of liquid. Furthermore, the heating device is likely to be damaged or destroyed (due to overheating) if it remains operative while no liquid flows therethrough. Additional damage can result under the action of escaping liquid which often contains corrosive chemicals. Such liquid is not only likely to contaminate the surrounding area but can also constitute a health hazard to the attendants. Furthermore, the cost of certain processing liquids is very high. Finally, the escape of processing liquid and/or the failure of processing liquid to circulate at an optimum rate and/or to receive requisite quantities of regenerator solution (replenisher) per unit of time invariably results in damage to or destruction of the processed material, such as webs of exposed photographic paper which are to be severed after development to yield discrete customer prints. The paper will be damaged if the supply of liquid in the tank or tanks of the processor drops below a predetermined level.

OBJECTS AND SUMMARY OF THE INVENTION

An object of the invention is to provide a processing apparatus which is constructed and assembled in such a way that minor mechanical damage to its parts does not entail larger damage or total destruction.

Another object of the invention is to provide an apparatus wherein leakage of liquid automatically results in stoppage or deactivation of that component or those components which are most likely to undergo serious damage as a result of reduced rate of liquid flow and/or as a result of complete termination of circulation of the liquid.

A further object of the invention is to provide an apparatus which is designed to protect the pump and/or the heating system in the event of leakage of fluid and/or on development of other defect or defects which affect the rate of circulation and the pressure of the liquid.

An additional object of the invention is to provide a novel and improved monitoring and control system for use in a processor for exposed photographic films or for webs of exposed photographic paper.

Another object of the invention is to provide an apparatus which is relatively simple and inexpensive, which can automatically warn the attendants in the event of malfunction, and which can automatically stop or deactivate all such components which are likely to be adversely affected by undue changes of pressure of the liquid.

The invention is embodied in an apparatus for processing photographic material, particularly for treating exposed photographic paper with a liquid developer. The apparatus comprises a liquid-containing vessel having at least one inlet and at least one outlet, conduit means connecting the inlet with the outlet outside of the vessel, a pumping device installed in the conduit means to draw liquid from the outlet and to convey the withdrawn liquid to the inlet, a heating device installed in the conduit means between the pumping device and the inlet to maintain the circulating liquid at a predetermined temperature or within an optimum range of temperatures, and novel and improved means for controlling the operation of at least one of the aforementioned devices as a function of the pressure of liquid in the conduit means. The controlling means comprises means for monitoring the pressure of liquid in the conduit means and means for deactivating the one device when the monitored pressure is outside of a predetermined range of capable pressures. The monitored pressure will be outside of the range of acceptable pressures in response to development of a leak in the conduit means, in response to clogging of the conduit means (e.g., in response to clogging of a filter which can be installed in the conduit means downstream of the heating device) and/or for a combination of such and/or other reasons.

The monitoring means preferably comprises two pressure responsive switches one of which transmits a signal when the pressure drops to the lower limit of the acceptable range and the other of which transmits a signal when the pressure reaches or exceeds the upper limit of the acceptable range. The manner in which the signals are processed is preferably the same, i.e., such signals can be processed in a suitable control unit to stop the motor of the pumping device and/or to disconnect the heating device from the energy source.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a schematic elevational view of a continuous developing apparatus which embodies the invention and wherein the material to be developed is caused to pass through a series of three tanks.

DESCRIPTION OF THE PREFERRED EMBODIMENTS

The drawing shows a continuous developing apparatus or processor having a liquid-containing vessel 1 which is composed of three tanks 1*a*, 1*b*, 1*c* disposed side-by-side. Each tank contains a liquid bath, and each such bath may but need not consist of a different liquid. The bottom portions of the tanks 1*a*–1*c* are respectively provided with outlets 2*a*, 2*b*, 2*c* which are connected to a common collecting conduit 3. The discharge end of the conduit 3 is connected to the suction intake of a pumping device 4. The intake of the pumping device 4 is further connected with a supply conduit 6 which receives preheated replenisher from a metering device 5. The direction of admission of replenisher from the metering device 5 into a heat exchanger 8 in the conduit 6 is indicated by the arrow 106. The heat exchanger 8 may be of the type disclosed in the commonly owned copending application Ser. No. 783,797 filed Apr. 1, 1977 by Erwin Laar et al. for "Apparatus for conditioning replenishers for developer solutions", now abandoned. The apparatus preferably comprises a tee 7 which receives liquid from the discharge end of the conduit 3 and from the supply conduit 6 so that the replenisher is mixed with the withdrawn liquid before the resulting mixture enters the pumping device 4. The heat exchanger 8 preferably raises the temperature of liquid replenisher to a level which is below the desired temperature of liquid in the vessel 1.

The outlet of the pumping device 4 is connected with a heating device 10 by a conduit 9. A conduit 11 conveys heated liquid from the device 10 to inlets 13*a*, 13*b*, 13*c* which are respectively provided in the upper portions of the tanks 1*a*, 1*b*, 1*c*. The conduit 11 contains a filter 12.

A thermometer 14 monitors the temperature of heated liquid in the conduit 11 upstream of the filter 12 and transmits appropriate signals to a control unit 15. The control unit 15 is further connected with the metering device 5 by conductor means 16.

In accordance with a feature of the invention, the conduit 11 contains a pressure monitoring assembly including two pressure-responsive switches 17 and 18 which are installed between the outlet of the heating device 10 and the thermometer 14. The upstream switch 17 transmits to the control unit 15 a signal via conductor means 19 when the pressure of liquid in the conduit 11 drops to a predetermined minimum value, and the downstream switch 18 transmits to the control unit 15 a signal via conductor means 20 when the pressure of liquid in the conduit 11 exceeds a preselected maximum value. For example, the switches 17 and 18 can be respectively adjusted to transmit signals at 1.2 and 5 mWs. Each of these switches may constitute a conventional commercially available diaphragm switch or the like.

The operation is as follows:

The pumping device 4 draws liquid developer from the lower portions of the tanks 1*a*–1*c* via outlets 2*a*–2*c* and conduit 3. The outlet of the pumping device 4 returns the withdrawn liquid to the inlets 13*a*–*13c* of the respective tanks 1*a*–1*c* via conduit 9, heating device 10, conduit 11 and filter 12. At the same time, the pumping device 4 draws metered quantities of preheated replenisher from the supply conduit 6. The thermometer 14 transmits signals which denote the actual temperature of liquid that flows in the conduit 11 toward the inlets 13*a*–13*c*, and the control unit 15 comprises suitable means of known design to regulate the operation of the heating device 10 so that the temperature of the liquid which is about to enter the tanks 1*a*–1*c* is always within an optimum range. The regulation of the heating device 10 is especially simple if it comprises one or more electric resistance heaters.

The conductor means 19 and 20 do not transmit any signals as long as the pressure of liquid in the conduit 11 is within an acceptable range between the predetermined minimum and maximum values. In other words, the operation of the apparatus is normal (i.e., the motor of the pumping device 4 is on and the heating device 10 is also on) as long as the pressure of the liquid in the conduit 11 is within the range selected by adjustment of the pressure responsive switches 17 and 18.

If the pressure of liquid drops below the predetermined minimum permissible value, the switch 17 transmits a signal to the control unit 15 via conductor means 19 whereby the unit 15 arrests the motor of the pumping device 4 (the conductor means which connects the control unit 15 with the motor of the pumping device 4 is not shown at 22). At the same time, the control unit 15 deactivates the heating device 10. This protects the heating device 10 from damage because the device 10 is automatically deactivated when the quantity of circulated liquid is too low to remove the minimum amount of heat energy which is supplied when the device 10 is on. In fact, the thermometer 14 can be adjusted in such a way that its signal deactivates the heating device 10 via control unit 15 as soon as the quantity (and hence the pressure) of liquid in the conduit 11 drops to a value at which the switch 17 transmits a signal. Stoppage of the pumping device 4 and deactivation of the heating device 10 is signaled by a display device 21 for visible signals. It is clear that the device 21 can furnish audible signals in addition to or instead of visible signals.

The maximum permissible pressure of liquid in the conduit 11 is reached, for example, in response to clogging of the filter 12. The switch 18 then transmits a signal via conductor means 20 whereby the control unit 15 arrests the motor of the pumping device 4 via conductor means 22 and deactivates the heating device 10 via conductor means 23. The rise of static pressure to or beyond a preselected value (at which the switch 18 transmits a signal) denotes that the quantity of liquid which enters the tanks 1*a*–1*c* per unit of time is too low.

The exact manner in which signals from the switches 17 and 18 are processed to effect stoppage of the pump motor and deactivation of the heating device 10 forms no part of the invention. For example, the switches 17, 18 may be connected in series with the holding circuits of suitable relays which, when deenergized, disconnect the motor of the pumping device 4 and the heating device 10 from a source of electric energy.

An important advantage of the improved apparatus is that the more expensive and/or sensitive components are protected from damage or destruction in the event of relatively minor defects, such as leakage of liquid at the one or other end of a conduit, clogging of the path for the flow of liquid between the outlets and inlets of the tanks, breakage of a conduit and/or a combination of such defects. The development of such defects not only results in stoppage or deactivation of one or more sensitive parts but is also indicated to the attendants in a manner to insure that the presence of a defect will be detected without delay in order to enable the attendants to rapidly restore the apparatus to normal operating condition.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. In a machine for processing photographic material, particularly for treating exposed photographic paper with a liquid developer, the combination of a liquid-containing vessel having at least one inlet and at least one outlet; conduit means connecting said outlet with said inlet; a pumping device installed in said conduit means to draw liquid from said outlet and to convey the withdrawn liquid to said inlet; a heating device installed in said conduit means between said pumping device and said inlet to maintain the temperature of the liquid within a given range; and means for controlling the operation of at least one of said devices as a function of the pressure of liquid in said conduit means, including means for monitoring the pressure of liquid in said conduit means, and means for deactivating said one device when the monitored pressure of liquid is outside of a predetermined range of pressures, said monitoring means comprising a first pressure responsive switch arranged to transmit a signal when the pressure in said conduit means drops to the lower limit of said predetermined range and a second pressure responsive switch arranged to transmit a signal when the pressure of liquid in said conduit means rises to the upper limit of said predetermined range.

2. The combination of claim 1, wherein said switches are installed in said conduit means intermediate said heating device and said inlet.

3. The combination of claim 2, further comprising a filter installed in said conduit means intermediate said switches and said inlet.

4. The combination of claim 1, further comprising means for monitoring the temperature of liquid in said conduit means downstream of said heating device and for adjusting said heating device when the monitored temperature deviates from a preselected range of temperatures.

5. The combination of claim 1, wherein at least a portion of said conduit means is flexible.

6. The combination of claim 1, wherein said inlet is disposed at a level above said outlet.

7. In a machine for processing photographic material, particularly for treating exposed photographic paper with a liquid developer, the combination of a liquid-containing vessel having at least one inlet and at least one outlet; conduit means connecting said outlet with said inlet; a pumping device installed in said conduit means to draw liquid from said outlet and to convey the withdrawn liquid to said inlet; a heating device installed in said conduit means between said pumping device and said inlet to maintain the temperature of the liquid within a given range; and means for controlling the operation of at least one of said devices as a function of the pressure of liquid in said conduit means, including means for monitoring the pressure of liquid in said conduit means, and means for deactivating said one device when the monitored pressure is outside of a predetermined range of pressures, said monitoring means comprising two pressure response switches mounted in said conduit means one downstream of the other intermediate said heating device and said inlet, said other switch being responsive to a pressure which is below said predetermined range and said one switch being responsive to a pressure which is above said predetermined range.

8. In a machine for processing photographic material, particularly for treating exposed photographic paper with a liquid developer, the combination of a liquid-containing vessel having at least one inlet and at least one outlet; conduit means connecting said outlet with said inlet; a pumping device installed in said conduit means to draw liquid from said inlet and to convey the withdrawn liquid to said inlet; a heating device installed in said conduit means between said pumping device and said inlet to maintain the temperature of the liquid within a given range; and means for controlling the operation of said devices as a function of the pressure of liquid in said conduit means, including means for monitoring the pressure of liquid in said conduit means, and means for deactivating said devices whenever the monitored pressure of liquid is outside of a predetermined range of pressures.

9. The combination of claim 8, wherein said monitoring means includes means for transmitting electric signals in response to detection of a pressure which is outside of said predetermined range and said deactivating means comprises a relay which is deenergized in response to such signals to thereby deactivate said one device.

* * * * *